United States Patent [19]

Gorran

[11] 4,135,500

[45] Jan. 23, 1979

[54] APPARATUS FOR OSCILLATING FLOTATION SUPPORT SYSTEMS

[75] Inventor: Jody A. Gorran, East Windsor, N.J.

[73] Assignee: Medpro, Inc., East Brunswick, N.J.

[21] Appl. No.: 791,960

[22] Filed: Apr. 28, 1977

[51] Int. Cl.[2] ..... A61H 1/00

[52] U.S. Cl. ..... 128/33

[58] Field of Search ..... 128/33, 64, 24.2, 1 C; 5/108, 109

[56] References Cited

U.S. PATENT DOCUMENTS

| | | | |
|---|---|---|---|
| 3,462,778 | 8/1969 | Whitney | 128/33 X |
| 3,492,988 | 2/1970 | De Mare | 128/33 |
| 3,587,568 | 6/1971 | Thomas | 128/33 |
| 3,760,801 | 9/1973 | Borgeas | 128/33 |
| 3,919,730 | 11/1975 | Regan | 128/33 X |
| 4,048,684 | 9/1977 | Korner et al. | 128/33 |

*Primary Examiner*—Lawrence W. Trapp
*Attorney, Agent, or Firm*—Weingram & Klauber

[57] ABSTRACT

Apparatus for coupling to a flotation support system as, for example, a water mattress or the like, for purposes of effecting periodic oscillations of said system. The apparatus comprises an expandable and collapsible air bladder, which is positioned beneath the system in force transmitting relationship therewith. An air pumping means is connected in a pneumatic circuit with the air bladder so as to pressurize the bladder and expand same against the overlying support system. Means are provided for periodically venting the pneumatic circuit and air bladder to atmosphere, in consequence of which the bladder collapses under the weight of the overlying system; and thereupon expands following the venting. The resultant expansions and contractions of the bladder thereby effect the desired oscillations of the system. The venting means may comprise a generally gas-tight enclosure positioned in series with the air pump and air bladder, the enclosure including an opening to atmosphere, means normally sealing said opening, and means for periodically unsealing the opening to effect the desired venting. The resulting oscillations of the said flotation support system are deemed to have beneficial effects, especially with respect to infants — e.g. where said system comprises all or part of an infant mattress assembly.

7 Claims, 6 Drawing Figures

APPARATUS FOR OSCILLATING FLOTATION SUPPORT SYSTEMS

BACKGROUND OF INVENTION

This invention relates generally to cushioning structures, and more specifically relates to apparatus for use with flotation support systems.

Flotation support systems such as mattress assemblies including fluid-containing envelopes for supporting an individual, have achieved a wide degree of commercial success in recent years. Such devices are desirable not only by virtue of the comfort afforded the user thereof, but they further have been deemed valuable for a variety of therapeutic reasons.

In recent years it has been reported that such flotation support systems, e. g. so-called "water beds" or the like, can be of special value when used to support infants, especially premature infants. Aside from the comfort and the excellent support afforded such infants, it is deemed that the water bed flotation promotes neurological development and behavioral maturation of the premature infant, possibly by partially simulating the natural, uterine environment. Reference may be had in the foregoing connection to the following two papers which are deemed especially pertinent to the present invention: (1) Korner et al "Effects of Water Bed Flotation on Premature Infants: A Pilot Study" *Pediatrics* Vol. 56, No. 3, pages 361–367, Sept. 1975; and (2) Kramer et al "Rocking Water Beds and Auditory Stimuli to Enhance Growth of Pre-term Infants," *The Journal of Pediatrics,* Vol. 88, No. 2, pages 297–299, Feb. 1976.

Both of the aforementioned articles are further pertinent in teaching the advantages of introducing to the flotation systems used with such infants, oscillatory or gently rocking motion. The introduction of such movement to the fluid within the support system, e. g. by in some manner coupling a mechanical force thereto, can create oscillations at a rate simulating the breathing or other physiological cycle, and this stimuli in turn has been found to yield the beneficial results previously discussed.

Prior reported apparatus for introducing the said oscillations to the fluid support system, have however been unduly complex, relatively costly to construct and lacking in dependable operation. For example, the aforementioned Korner article reports that oscillations can be so introduced by use of a small inflatable rubber bladder connected to a conventional medical respirator, which inflates and deflates the bladder at 16 ± 4 times per minute. However, the said respirator is, needless to say, complex and costly apparatus not especially adapted to the present use; and it is hardly appropriate to displace the said device from its more usual and urgent applications for purposes as outlined.

In accordance with the foregoing, it may be regarded as an object of the present invention, to provide apparatus for introducing oscillations into flotation support systems and structures, which apparatus is of very low cost construction, and of highly dependable design.

It is a further object of the present invention, to provide apparatus of the aforementioned type, which includes features enabling adjustment of the yielded oscillation rate in a simple and dependable manner.

SUMMARY OF THE INVENTION

Now in accordance with the present invention, the foregoing objects, and others as will become apparent in the course of the ensuing specification, are achieved in apparatus combineable with a flotation support system for introducing periodic pressure displacements to the system to effect oscillations thereof. The apparatus may comprise an expandable and contractable gas bladder underlying the system and mechanically coupled therewith, whereby expansions and contractions of the bladder are coupled to the system. A relatively constant gas pressure source is connected in a pneumatic circuit with the gas bladder for pressurizing the latter to expand same; and means are provided for periodically venting the pneumatic circuit and thereby the bladder to atmosphere, whereby the bladder contracts in response to the forces coupled thereto from the overlying system and thereupon expands following termination of venting. The coupling of the resultant expansions and contractions of the bladder to the system effects the desired oscillations.

The said gas pressure source preferably comprises an air pump of a type providing a relatively even or constant flow. The venting means may include a buffer volume connected in the pneumatic circuit in series with the air pump and bladder. A normally closed valve is connected to the buffer volume, and means are provided for periodically actuating the valve to open same and thereby effect the venting.

The buffer volume may be defined by an enclosure which includes at least one opening to atmosphere. A rotatable valve body is mounted for rotation external to the enclosure, with the valve body normally sealing with the enclosure opening, but including an opening therethrough alignable with the enclosure opening. Motor means rotate the valve body to effect periodic alignment of the valve body opening with the enclosure opening to effect the periodic venting.

The rotational rate of the valve body may be varied by controlling the speed of the motor used therewith. Pursuant to one aspect of the invention one can thus control the frequency of venting, and thereby the frequency of introduced oscillations.

The valve body may include a plurality of openings therein, each alignable with the enclosure opening (which opening may also be plural in nature), whereby the ventings occur a plurality of times during each complete rotation of the valve body.

Pursuant to a further aspect of the invention, means may be provided for selectively closing some of the plurality of openings which can be provided on the valve body, to thereby determinatively vary the resultant frequency of venting and of consequent oscillations.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
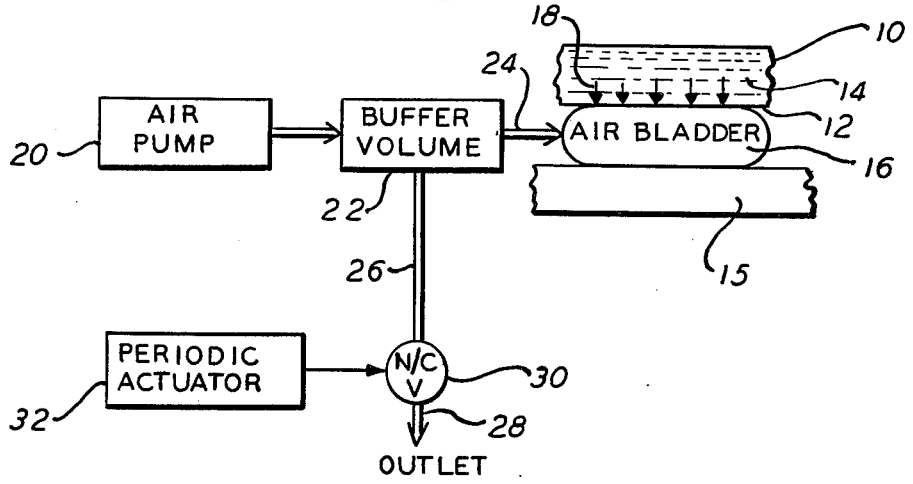
FIG. 1 is a schematic block diagram, illustrating typical elements in apparatus in accordance with the present invention; the view further depicts the manner in which the said elements interact with the flotation support system with which they are associated.

In FIG. 1 herein, apparatus in accordance with the present invention is set forth, shown in schematic fashion in use with a flotation support system, a portion of which is schematically shown at 10. The said flotation system 10 is per se a conventional device, which may, for present purposes, be considered to include an envelope 12 e. g. of a fluid impervious material such as a polyvinyl chloride plastic or the like. Envelope 12 contains therein a fluid 14. The said fluid preferably comprises a liquid such as water, but other liquids including materials of greater or lesser viscosity than water may be utilized as is known in the art; and similarly other flowable and semi-flowable materials, including gels, slurries, etc. can be used for filling the interior of envelope 12. In any event it will be clear, again as is well known in the art, that the resultant flotation system 10 provides a highly compliant structure.

An underlying non-compliant support base 15 for system 10 is also schematically depicted. Base 15 can, for example, comprise the bottom portion of an incubator, bassinet, crib or so forth.

Pursuant to the present invention there is positioned directly beneath flotation system 10 an air bladder 16. The said air bladder may be comprised of a flexible walled material, which can thus be expanded and contracted depending upon the internal pressure thereof. Thus the bladder may comprise a plastic material such as polyvinyl chloride previously mentioned, or can comprise a natural or artificial rubber or the like.

Air bladder 16 is seen in the schematic showing of FIG. 1 to reside upon base 15 and to be in direct contact with the overlying flotation support system 10; i.e. the respective walls of system 10 and bladder 16 directly contact one another. Pursuant to the invention, the object is to assure that mechanical coupling exists between the two, so that expansions and contractions in the air bladder are mechanically coupled to flotation suppor system 10. Accordingly it is possible for intervening materials to be present (as some times will be the case) e.g. where an additional thin cover or the like is provided beneath the flotation system.

It will in any event be seen that the said flotation system, since it overlies the air bladder, will by virtue of its weight provide a counter pressure against air bladder 16—as is suggested by arrows 18, which are indicative of the force defined by such weight.

Air bladder 16 may have dimensions appropriate for the particular flotation support system 10 with which it is associated. The said air bladder may in fact only be present under a limied/area of the said flotation system; or may be present under a substantial part thereof. Since the principal objective is to transmit oscillations or pressure pulses to the flotation system it will generally be preferable for the bladder to be of limited extent, i. e. only underlying perhaps 10 to 20% of the system. In consequence of its limited dimensions the bladder volume will in turn be limited, which enables use of remaining components of limited capacity and consequent low cost.

It is seen that air bladder 16 is in a pneumatic circuit which includes in series an air pump 20, and a buffer volume 22 together with the said air bladder. Air pump 20 may be a relatively conventional low-cost type device, which is electrically or otherwise operated to provide a relatively constant pressure and flow source. For example, an air pump of the type produced by the Aquarium Pump Supply, Inc. Of Prescott, Arizona is suitable for the present purposes. It should be understood that when reference is made here to "relatively constant pressure" or "to relatively constant flow", these terms are intended to differentiate the flow provided from pump 20 from an oscillatory or intermittent flow—as might be provided from a complex respirator. It is thus contemplated that pump 20 can in fact provide a flow which in the strictest sense can be somewhat pulsating, e.g. by virtue of reciprocations of a piston and cylinder therein where said pump comprises a mechanical movement of that type. However, to an individual observing the said flow without aid of instrumentation, the flow and pressure for all practical purposes will be deemed constant.

The flow from the pump 20 is thus provided to a buffer volume 22 which can comprise a simple enclosure, with the flow from such volume being provided, as by line 24 to the aforementioned air bladder 16 in series therewith.

Connected to buffer volume 22, in a bypassing relationship, is an outlet line 26, which passes to atmosphere at 28 via a normally closed valve 30. The said valve is periodically actuated by an actuator means depicted schematically at 32.

It will be evident from the foregoing that the basic operation involved in the apparatus of FIG. 1 is as follows: The relatively constant pressure and flow source exemplified by pump 20 provides air flow into buffer volume 22, and thence in the continuing pneumatic circuit to air bladder 16, which thus undergoes expansion in turn transmitting the force of such expansion to the overlying flotation system 10. Periodically actuator 32 opens valve 30, to thereby vent the buffer volume 2 to atmosphere, in turn venting the entire pneumatic circuit to atmosphere including pump 20 and especially air bladder 16.

During the venting, air bladder 16 under the force of overlying system 10 transiently collapses, feeding its gas contents out through line 26 to atmosphere. Upon valve 30 returning to its normally closed position, pressure again begins to build within buffer volume 22 and air bladder 16, in turn recycling the action previously discussed; i.e. pressure in once again applied from the underlying air bladder 16 against system 10; subsequently bladder 16 collapses via the venting procedure, with the cycle repeating periodically. It will be evident that by suitable control of actuator 32, and depending upon the air pumping rate, the air bladder volume, etc. oscillations will be thus introduced into system 10 in accordance with the factors mentioned.

Figure 2:
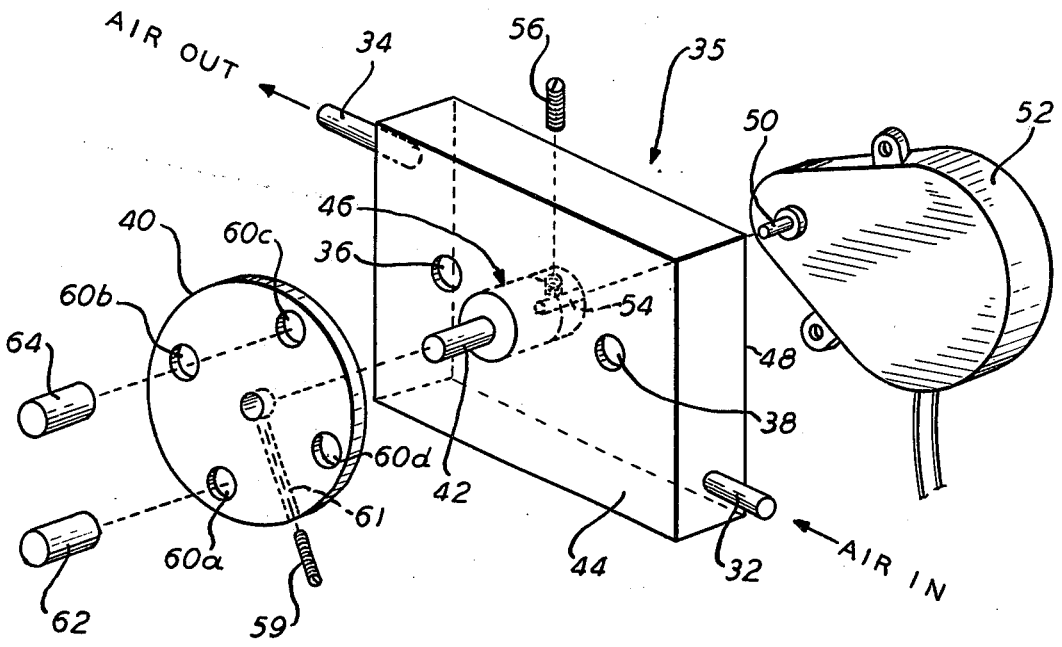
FIG. 2 is an exploded perspective view of a first embodiment of apparatus in accordance with the present invention.

In FIG. 2 herein there is set forth a first embodiment of apparatus including the buffer volume 22, valve 30 and periodic actuator 32 of FIG. 1. Thus the apparatus portions depicted in FIG. 2 may be connected to a conventional air pump as at 20 in FIG. 1, and then utilized with the remainder of the system, most specifically the bladder 16 of the earlier Figure.

It is thus seen in FIG. 2 that buffer volume 22 takes the form of a hollow enclosure 35 (of plastic, metal or so forth), which is provided with a gas flow inlet means 32, and gas flow outlet means 34. Thus air or other gas from a pump as at 20 in FIG. 1 is provided to inlet 32; and after proceeding through enclosure 35 passes from outlet 34, and thence to air bladder 16.

The enclosure 35 is seen to include a pair of openings 36 and 38, which are capable of venting the interior volume of the enclosure — and thus the entire pneumatic system including bladder 16 — to atmosphere.

Openings 36, 38 are normally closed by a valve body, which constitutes a simple disc 40. The view of FIG. 2 is, of course, exploded; when the device shown is fully assembled, disc 40 rides upon a drive shaft 42 to which it is affixed by means of a set screw 59 which passes transversely through a threaded opening 61 in the disc and engages with shaft 42, with one surface of the disc being in contact with the surface 44 of enclosure 35. A thin layer of a lubricant as, for example, a natural or artificial grease, may be provided at the interface between disc 40 and wall 44 of enclosure 35 to improve the sealing characteristics, and also to facilitate rotation of the disc.

It is seen that shaft 42 is part of an axis assembly 46. The entire assembly, if desired, can be formed as a unit, for example. Indeed enclosure 35 may be formed of a molded plastic or the like, as may the axle assembly 46. The said axis assembly 46 is seen to be journaled for rotation within openings provided at the front and rear walls 44 and 48 of enclosure 35. The axle assembly 46 is rotatably driven by a drive shaft 50, which is the output portion of a motor assembly 52. Drive shaft 50 slips within an opening 54 in axis assembly 46, and then is locked frictionally therein by means of a set screw 56 which passes transversely through a threaded opening in axis assembly 46 and engages with shaft 50.

Motor assembly 52 is a conventional off-the-shelf device; and can typically comprise a simple constant speed synchronous motor, such as a timing motor of this type produced by the Autrol Corp. of Crystal Lake, I11, which device is conventionally used as a timing motor for gears or the like. It is also within the province of the invention for the motor assembly to comprise a variable speed motor together with a speed control for same — in order that the rate of rotation of disc 40 might be varied for purposes as will be discussed.

The venting, i.e. the valving action of the device of FIG. 2, may now be understood by noting that disc 40 is provided with a plurality of openings **60*a*, 60*b***, etc. representatively shown as four in a number.

It will now be evident that by virtue of rotation of disc 40, the openings **60*a*, 60*b*, etc. will be periodically aligned with the openings 36 and 38 in enclosure 35, at which time the venting action will occur. As soon as the disc thereupon rotates beyond the alignment position, it will further be evident that the venting action ceases, i.e. effectively the valve 30 of FIG. 1** is closed, not to be reopened until a further alignment occurs.

In a typical application of the present invention the motor assembly 52, e.g. if on the synchronous type previously discussed, can have a relatively constant speed — e.g. of 8 rpm. Thus with the arrangement shown in FIG. 2 it will be evident that four times during each rotation, venting of enclosure 35 occurs, yielding an approximate pressure pulse (or venting) rate in this instance of 32 pulses (or ventings) per minute, i.e. 32 expansions and consequent contractions of the air bladder 16. This is a quite desirable rate — as same approximately corresponds to an infant's respiration rate.

It will be further noted in the device of FIG. 2 that a pair of plugs 62, 64 are provided. These plugs — which comprise rubber or other compressible material — may optionally be inserted within selected openings **60*a*, 60*b*, etc. of disc 40 as, for example, the two openings 60*a* and 60*c* depicted. By inserting such plugs a simple technique is enabled for modifying the venting rate from enclosure 35, i.e. in the depiction shown the said rate can be immediately modified by insertion of the two plugs 62, 64 so that venting now occurs but 16 times/minute, where an 8 rpm motor is used. This approximates the adult human respiration rate. It will be further evident, however, that by employing various combinations of openings on enclosure 44 with openings on disc 40**, and through intermediate use of plugs as discussed, various venting rates can be obtained.

For example, if a single opening 38 is provided at enclosure 35, and but a single opening at disc 40 alignable therewith, then using an 8 rpm motor, eight pulsations (or ventings) per minute can be produced. But by doubling the number of openings on disc 40 and using the same rotational speed for the disc, the pulses (or ventings) can be increased to 16 per minute or so forth; and similarly by plugging of openings already provided on disc 40 the said rate can be suitably modified.

In FIGS. 3 through 6 herein a further embodiment of the buffer volume 22, and periodically actuated valving mechanism is set forth. Thus the device of FIGS. 3 through 6 functions in a manner precisely identical to that of FIG. 2, except for certain differences in the component relations.

Figure 5:
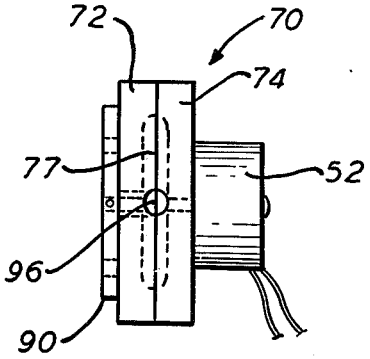
FIG. 5 is a side elevational view of the assembled second embodiment of the present invention.

In particular the apparatus portions depicted in FIG. 5, includes a buffer volume in the form of an enclosure, consisting of an upper member 72 and lower member 74, which are fitted against each other in face-to-face relationship.

Figure 3:
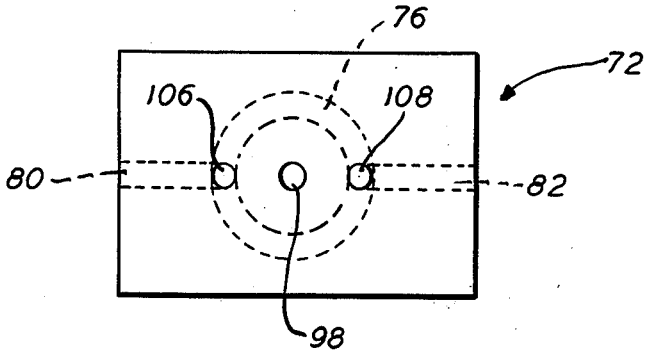
FIG. 3 is a top plan view of the upper half of a buffer volume enclosure utilizable in a second embodiment of the invention.
Figure 4:
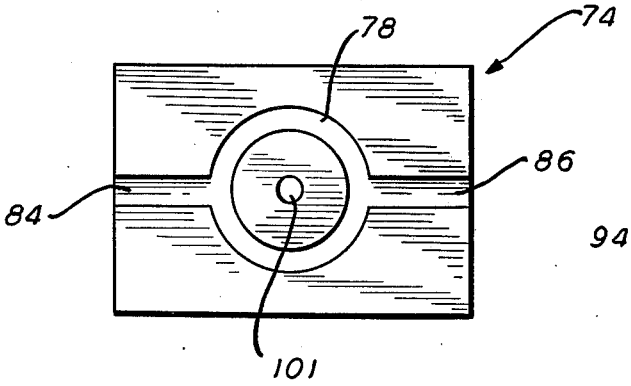
FIG. 4 is a top plan view of the second portion of the enclosure referred to in the preceding paragraph.
Figure 6:
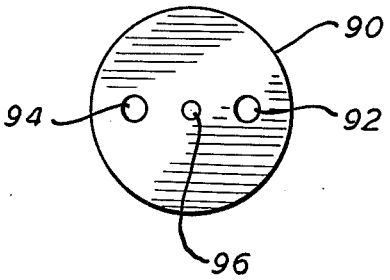
FIG. 6 is a plan view of the disc-like valve body employed in the apparatus of FIG. 5.

Referring to FIGS. 3 and 4 in conjunction with FIG. 5 it is seen that each member 72 and 74 is provided with an annular recessed groove 76 and 78; and that transverse grooves 80, 82, 84 and 86 pass into the annular grooves 76 and 78.

Thus when the two members 70 and 72 are assembled in face-to-face relationship as in FIG. 5, the annular grooves 76 and 78 combine to form a toroidal-shaped buffer volume space 77 (FIG. 5), with communication channels being provided to the toroidal space 77 at opposed ends thereof by virtue of the aforementioned transverse grooves. Specifically, the grooves 82 and 86 when placed in face-to-face relationship, define a small cylindrical channel which can be seen at 96, which channel effectively constitutes the air inlet proceeding from pump 20; the alternate channel, which is defined by grooves 80 and 84 thus comprises the outlet from the buffer volume 77 — effectively corresponding to outlet 34 in FIG. 2.

In the instance of the device shown at FIGS. 3 through 6 a valve body, in the form of a disc 90 is once more provided. This disc 90 functions in a manner precisely analagous to that discussed in connection with disc 40 in FIG. 2, i.e. disc 90 is provided with a pair of openings 92, 94. The disc is rotatable about its center 96, defined by an opening which mounts to the shaft of motor assembly 58 as previously discussed in connection with FIG. 2.

The special advantage of the arrangement of FIGS. 3 through 6, is that the said motor shaft may, in the instance of the device depicted, pass through the openings 98 and 101 in members 72 and 74, which define a support journaling for the said shaft. Particularly to be noted is that the shaft where so journaled in no way intersects the buffer volume 77; and thus problems of sealing the rotating shaft from such volume are completely eliminated in the version of the device shown in the FIGS. 3 through 6. This is to say that the buffer volume 77 communicates only with its inlet-outlet, and with atmosphere via the venting provided upon the disc 90 rotating to a suitable position to align openings 92 and 94 therein with corresponding openings 106 and 108 which pass through member 72 and thus communicate with buffer volume 77.

While the present invention has been particularly described in terms of specific embodiments thereof, it will be understood in view of the instant disclosure that numerous variations upon the invention are now enabled to those skilled in the art, which variations yet reside within the scope of the instant teaching. Accordingly the invention is to be broadly construed, and limited only by the scope and spirit of the claims now appended hereto.

I claim:

1. In combination with a flotation support system, apparatus for introducing periodic pressure displacements to said system to effect oscillations thereof; said apparatus comprising:

an expandable and contractable gas bladder underlying said system and mechanically coupled therewith, whereby expansions and contractions of said bladder are coupled to said system;

a relatively constant gas pressure source connected for pressurizing said bladder to expand same;

a buffer volume connected in series with and between said gas pressure source and said bladder; said gas pressure source and said bladder being in permanent open communication with said buffer volume; a normally closed valve means connected to said buffer volume; and means for periodically actuating said valve means to open same and thereby effect periodic venting of said buffer volume, and thereby said bladder to atmosphere; whereby said gas bladder contracts in response to the forces coupled thereto from said overlying system and thereupon expands following termination of said venting; the coupling of the resultant expansions and contractions of said bladder to said system, effecting said oscillations thereof.

2. Apparatus in accordance with claim 1, wherein said gas pressure source comprises an air pump.

3. Apparatus in accordance with claim 2, wherein said buffer volume is defined by an enclosure including at least one opening to atmosphere; a rotatable valve body being mounted for rotation external to said enclosure; said body normally sealing with said opening, but including an opening therethrough alignable with said enclosure opening; and motor means for rotating said valve body to effect periodic alignment of said valve body opening with said enclosure opening to effect said periodic venting.

4. Apparatus in accordance with claim 3, further including means for controlling the rotational rate of said valve body to thereby control the frequency of said venting and thereby the frequency of said oscillations.

5. Apparatus in accordance with claim 3, wherein said valve body includes a plurality of said openings, each alignable with said enclosure opening, whereby said ventings occur a plurality of times during each complete rotation of said valve body.

6. Apparatus in accordance with claim 5, further including means for selectively closing the openings of said valve body, to thereby determinatively vary the resultant frequency of said ventings and consequent oscillations.

7. Apparatus in accordance with claim 5, further including a plurality of said openings through said valve body.

* * * * *